US009961973B2

(12) United States Patent
Kaplan

(10) Patent No.: US 9,961,973 B2
(45) Date of Patent: May 8, 2018

(54) WALKING CANE CLAMP AND BASE FOR USE WITH WALKERS AND ROLLATORS

(71) Applicant: Medical Depot, Inc., Port Washington, NY (US)

(72) Inventor: Garreth Kaplan, Lloyd Harbor, NY (US)

(73) Assignee: MEDICAL DEPOT, INC., Port Washington, NY (US)

( * ) Notice: Subject to any disclaimer, the term of this patent is extended or adjusted under 35 U.S.C. 154(b) by 0 days. days.

(21) Appl. No.: 15/240,076

(22) Filed: Aug. 18, 2016

(65) Prior Publication Data

US 2017/0332748 A1 Nov. 23, 2017

Related U.S. Application Data

(63) Continuation-in-part of application No. 29/565,598, filed on May 23, 2016, which is a continuation-in-part of application No. 29/565,600, filed on May 23, 2016.

(51) Int. Cl.
*A45B 1/04* (2006.01)
*A61H 3/04* (2006.01)
(Continued)

(52) U.S. Cl.
CPC ..... *A45B 1/04* (2013.01); *A61H 3/04* (2013.01); *A45B 9/04* (2013.01);
(Continued)

(58) Field of Classification Search
CPC ..... A61H 2003/002; A61H 3/0244; A61H 2003/025; A61H 2003/0255;
(Continued)

(56) References Cited

U.S. PATENT DOCUMENTS 4,748,994 A * 6/1988 Schultz ..... A61H 3/04 135/67
5,499,856 A * 3/1996 Sorrell ..... A61H 3/04 135/66

(Continued)

*Primary Examiner* — David R Dunn
*Assistant Examiner* — Danielle Jackson
(74) *Attorney, Agent, or Firm* — Carter, DeLuca, Farrell & Schmidt, LLP

(57) ABSTRACT

A walking cane clamp is provided which includes a clip dimensioned and configured to releasably secure the walking cane clamp to a support member, the clip being attached to a cane fastener, the cane fastener including a body portion and a biasing member pivotally attached to the body portion, the body portion defining an opening and a receptacle dimensioned and configured to receive a portion of a cane shaft, the biasing member defining an open position and a closed position of the receptacle, the biasing member being pivotally biased toward the closed position in which a portion of the biasing member covers a portion of the opening sufficient to secure the cane shaft within the receptacle. Also provided is a system for securing a walking cane to a walker or a rollator which includes a walking cane clamp as described herein and a base for receiving the walking cane. Also provided is a walker or rollator which includes a walking cane clamp as described herein and an optional base for receiving a walking cane.

30 Claims, 9 Drawing Sheets

(51) Int. Cl.
*A61H 3/02* (2006.01)
*A45B 9/04* (2006.01)
*A61H 3/00* (2006.01)

(52) U.S. Cl.
CPC .. *A61H 2003/002* (2013.01); *A61H 2003/025* (2013.01); *A61H 2003/0261* (2013.01)

(58) Field of Classification Search
CPC ..... A61H 2003/0261; A45B 1/04; Y10T 24/3435; Y10T 24/3444; Y10T 24/44017
See application file for complete search history.

(56) References Cited

U.S. PATENT DOCUMENTS 6,318,392 B1 * 11/2001 Chen ..... A61H 3/04 135/66
6,601,865 B1 * 8/2003 Harper ..... A61G 5/08 280/304.1
6,634,609 B2 * 10/2003 Zheng ..... A45B 11/00 248/277.1
7,021,324 B1 * 4/2006 Clay ..... A61H 3/04 135/66
7,278,436 B2 * 10/2007 Gale ..... A45B 7/00 135/67
8,714,170 B1 * 5/2014 Bonne ..... A45B 3/00 135/66
9,107,481 B2 * 8/2015 Catchings ..... A45B 3/00
9,254,021 B2 * 2/2016 Paybins ..... A45B 3/00
9,351,901 B1 * 5/2016 Petsch ..... A63B 22/001
9,456,670 B2 * 10/2016 Wood ..... A45B 3/00
2005/0098695 A1 * 5/2005 Hollenbeck ..... A61H 3/0244 248/229.26
2011/0226296 A1 * 9/2011 Huggins ..... A45B 1/00 135/66
2012/0187265 A1 * 7/2012 Bakerman ..... A61H 3/0244 248/220.22
2015/0001359 A1 * 1/2015 Catchings ..... F16M 11/041 248/220.22
2016/0310343 A1 * 10/2016 Julos ..... A61H 3/04
2017/0020248 A1 * 1/2017 Wood ..... A45B 3/02

* cited by examiner

WALKING CANE CLAMP AND BASE FOR USE WITH WALKERS AND ROLLATORS

CROSS-REFERENCE TO RELATED APPLICATIONS

This application claims the benefit of, and priority to, U.S. Design patent application Ser. No. 29/565,598, filed on May 23, 2016, and U.S. Design patent application Ser. No. 29/565,600, filed on May 23, 2016, both of which are hereby incorporated herein by reference in their respective entireties.

BACKGROUND

1. Technical Field

This disclosure relates to devices for securing walking canes to walkers and rollators.

2. Description of Related Art

Walking canes, walkers and rollators are well-known aids for assisting mobility of elderly, infirm or injured patients. Walkers and rollators typically provide the user with a great deal of stability and support, especially, e.g., when the user is frail or experiencing problems with balance. Walkers and rollators are relatively large and typically require the user to operate them with one or both hands during ambulation. As a result, the user may find it difficult or clumsy to carry objects while using them. Accordingly, walkers or rollators may be equipped with baskets to assist with carrying objects. Since walkers and rollators are relatively large, users may find it difficult to maneuver them in tight spaces. Walking canes are far lighter, much easier to transport and provide the capable user with more maneuverability than walkers or rollators. However, walking canes are less stable than walkers or rollators and, depending on conditions such as fatigue and/or environment, a user may find better assistance with a walker or rollator. It would be useful to allow the user of a walker or rollator to use the walker or rollator as a way to transport a walking cane to various locations, thereby allowing the user to switch back and forth between using the walker or rollator and the walking cane at those locations.

SUMMARY

A walking cane clamp is provided which includes a clip dimensioned and configured to releasably secure the walking cane clamp to a support member, the clip being attached to a cane fastener, the cane fastener including a body portion and a biasing member pivotally attached to the body portion, the body portion defining an opening and a receptacle dimensioned and configured to receive a portion of a cane shaft, the biasing member defining an open position and a closed position of the receptacle, the biasing member being pivotally biased toward the closed position in which a portion of the biasing member covers a portion of the opening sufficient to secure the cane shaft within the receptacle. In embodiments, the biasing member is spring loaded. In embodiments, the biasing member has a first end and a second end, the first end defining a cam surface for abutting the portion of the cane shaft when in the closed position and the second end defining a tail portion which acts as a lever for pushing the biasing member into the open position. In embodiments, the clip is rotatable relative to the cane fastener.

A system for securing a walking cane to a walker or a rollator is provided which includes a walking cane clamp and a base for receiving the walking cane, the walking cane clamp including a clip dimensioned and configured to releasably secure the walking cane clamp to a support member, the clip being attached to a cane fastener, the cane fastener including a body portion and a biasing member pivotally attached to the body portion, the body portion defining an opening and a receptacle dimensioned and configured to receive a portion of a cane shaft, the biasing member defining an open position and a closed position of the receptacle, the biasing member being pivotally biased toward the closed position in which a portion of the biasing member covers a portion of the opening sufficient to secure the cane shaft within the receptacle, the base for receiving the walking cane including a base clip for securing the base for receiving the walking cane to the support member, the base for receiving the walking cane including a receptacle for receiving an end of the walking cane, wherein the walking cane clamp and the base for receiving the walking cane cooperate to secure the walking cane to the support member. In embodiments, the base for receiving the walking cane is dimensioned and configured to receive a cane tip. In embodiments, the base for receiving the walking cane is dimensioned and configured to receive a tripod base of a tripod cane. In embodiments, the base for receiving the walking cane is dimensioned and configured to receive both a cane tip and a tripod base of a tripod cane. In embodiments, the base for receiving the walking cane includes at least one drainage port.

A walker or rollator is provided which includes a pair of side frames, each side frame including a front leg, a rear leg, at least one hand rail, and at least one cross-member joining each side frame, and a walking cane clamp which includes a clip dimensioned and configured to secure the walking cane clamp to the walker or rollator, the clip being attached to a cane fastener, the cane fastener including a body portion and a biasing member pivotally attached to the body portion, the body portion defining an opening and a receptacle dimensioned and configured to receive a portion of a cane shaft, the biasing member defining an open position and a closed position of the receptacle, the biasing member being pivotally biased toward the closed position in which a portion of the biasing member covers a portion of the opening sufficient to secure the cane shaft within the receptacle. In embodiments, the walker or rollator includes a base for receiving the walking cane, the base for receiving the walking cane including a base clip for securing the walking cane base to the walker or rollator, the base for receiving the walking cane including a receptacle for receiving an end of the walking cane, wherein the walking cane clamp and the base for receiving the walking cane cooperate to secure the walking cane to the walker or rollator. In embodiments, the walking cane clamp and the base for receiving the walking cane are both secured to a single front leg or a single rear leg. In embodiments, the walking cane clamp and the base for receiving the walking cane cooperate to orient the walking cane parallel to the single front leg or the single rear leg. In embodiments, the walking cane clamp and the base for receiving the walking cane are both secured to the at least one cross-member. In embodiments, the walking cane clamp and the base for receiving the walking cane cooperate to orient the walking cane parallel to the at least one cross-member. In embodiments, the biasing member is spring loaded. In embodiments, the body further includes a stop which prevents the biasing member from extending fully past the opening. In embodiments, the biasing member has a first end and a second end, the first end defining a cam surface for abutting the portion of the cane shaft when in the closed position and the second end defining a tail portion which acts as a lever for pushing the biasing member into the open position. In embodiments, the base for receiving the walking cane is dimensioned and configured to receive a tripod base of a tripod cane. In embodiments, the base for receiving the walking cane is dimensioned and configured to receive a cane tip. In embodiments, the base for receiving the walking cane is dimensioned and configured to receive both a cane tip and a tripod base of a tripod cane. In embodiments, the base for receiving the walking cane includes at least one drainage port.

DETAILED DESCRIPTION

Figure 2:
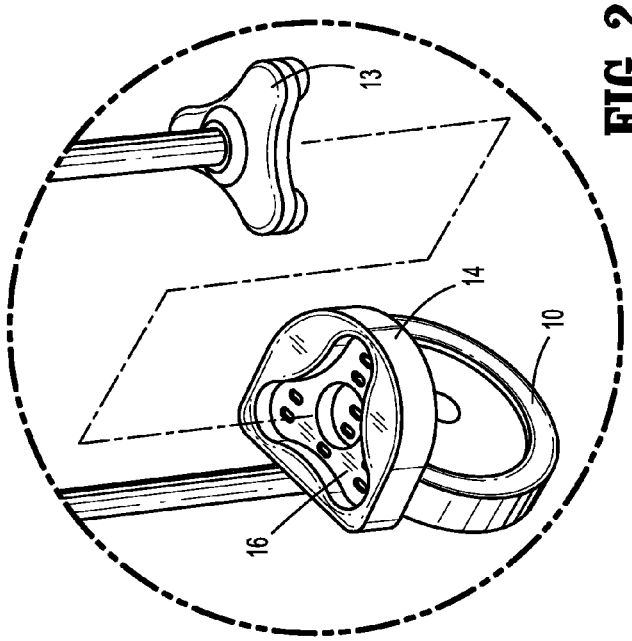
FIG. 2 is an enlargement of the highlighted portion 2 of FIG. 1 depicting the base for receiving a walking cane and bottom portion of the tripod walking cane and placement of the bottom portion of the tripod cane in the base.
Figure 3:
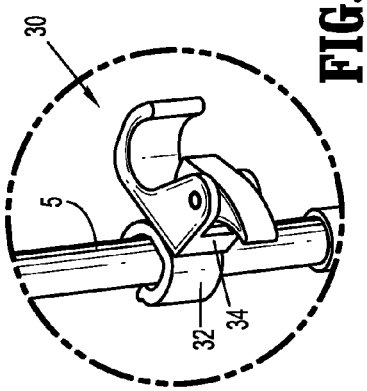
FIG. 3 is an enlargement of the highlighted portion 3 of FIG. 1 depicting the walking cane clamp mounted to the front leg.
Figure 1:
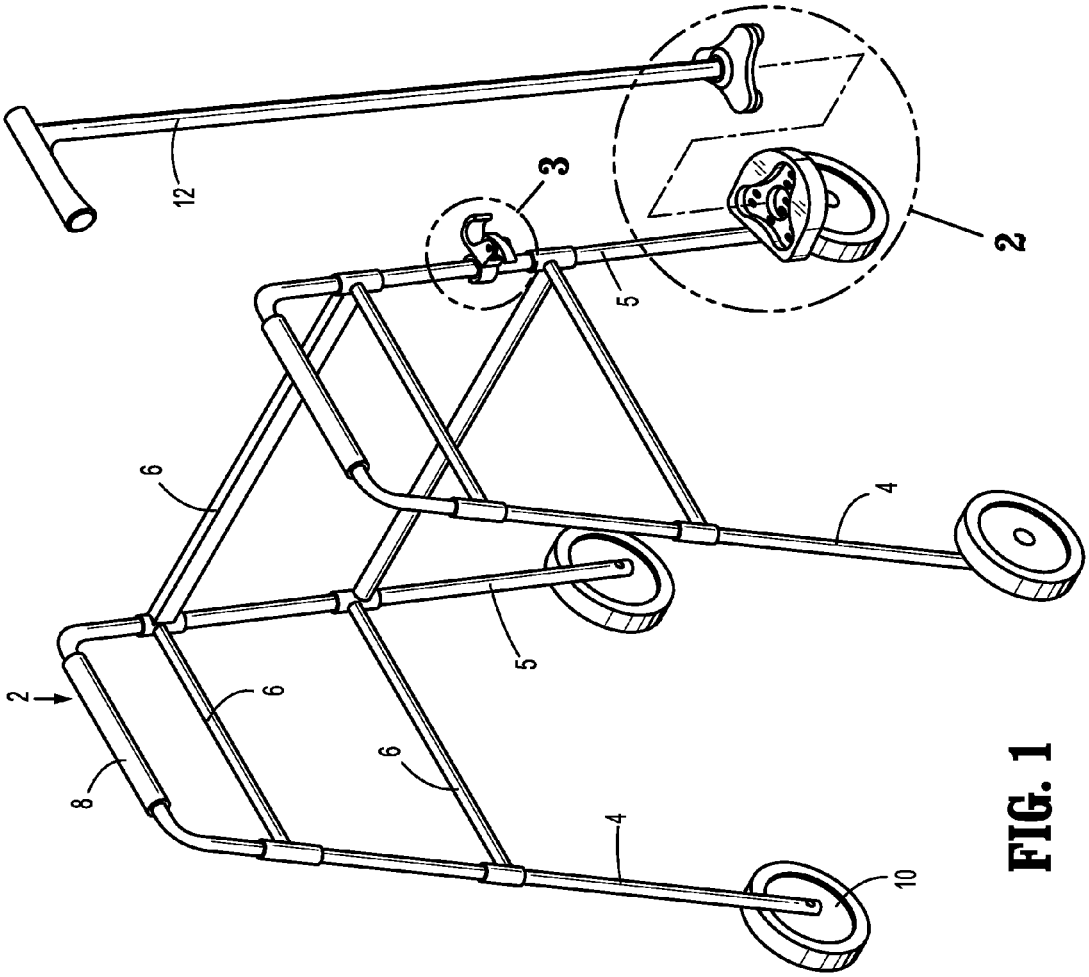
FIG. 1 is a perspective view of a rollator and a tripod walking cane, illustrating placement of a walking cane clamp and a base for receiving a walking cane on a front leg of the rollator.
Figure 6:
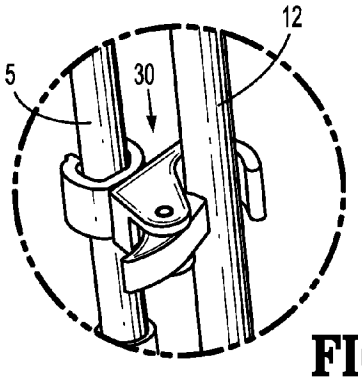
FIG. 6 is an enlargement of the highlighted portion 6 of FIG. 4 depicting the walking cane clamp mounted to the front leg and walking cane secured to the walking cane clamp.
Figure 5:
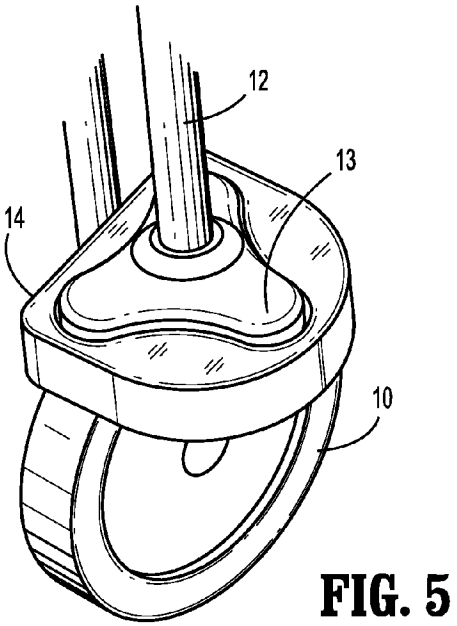
FIG. 5 is an enlargement of the highlighted portion 5 of FIG. 4 depicting the base for receiving a walking cane and bottom portion of the tripod walking cane within the base.
Figure 4:
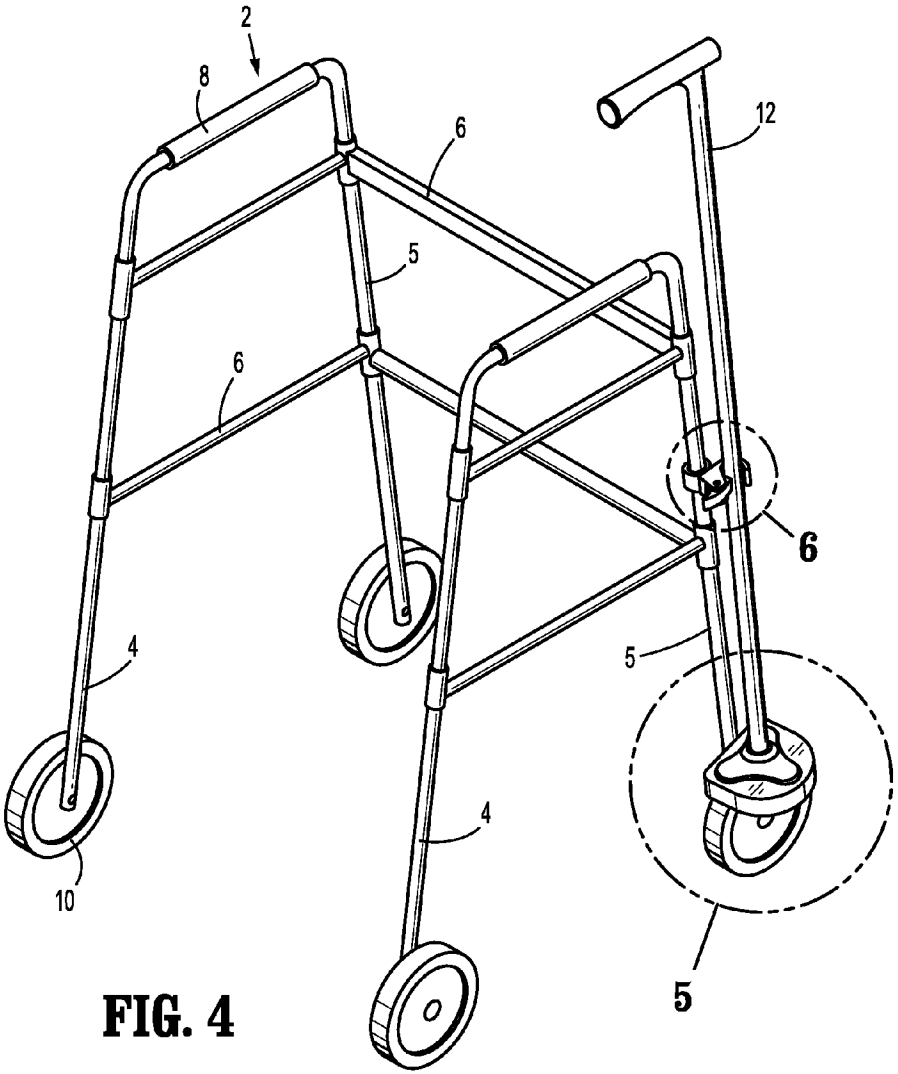
FIG. 4 is a perspective view of the rollator, walking cane clamp, base for receiving a walking cane, and walking cane of FIG. 1, wherein the walking cane is mounted to the rollator via the walking cane clamp and base for receiving a walking cane.
Figure 7:
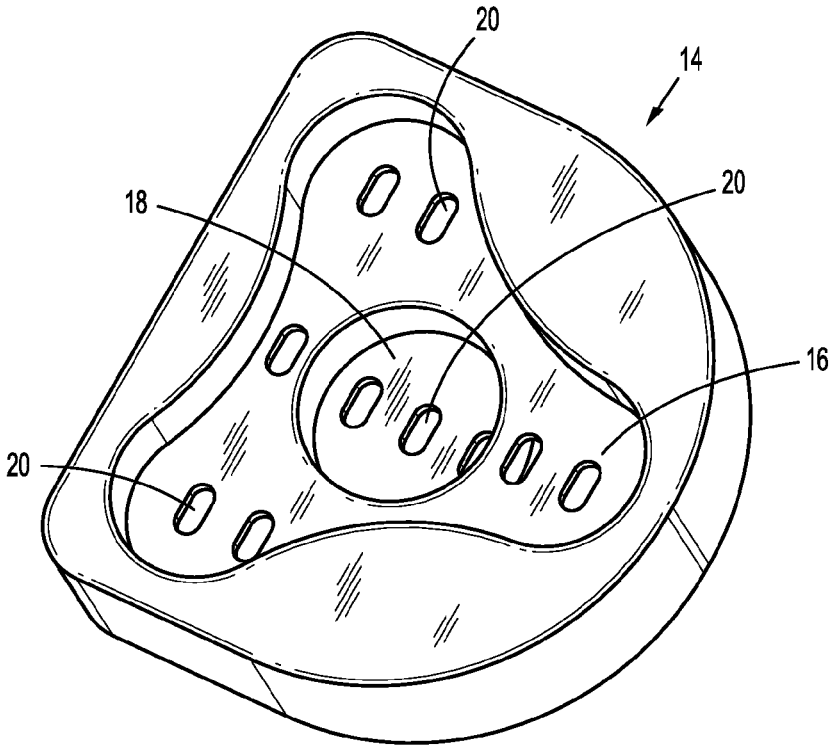
FIG. 7 is a perspective view of the base for receiving a walking cane containing a receptacle for a tripod cane base, a receptacle for a single cane tip and drainage ports within the base.

Provided herein is a walking cane clamp (the "clamp") for securing the walking cane to a walker or a rollator. In embodiments, the clamp cooperates with a base for receiving an end of the walking cane. The walking cane clamp allows the user of a walker or rollator to use the walker or rollator as a way to transport a walking cane to various locations, thereby allowing the user to easily switch back and forth between using the walker or rollator and the walking cane at those locations. The clamp is spring loaded and provides a convenient modality for a user to secure a walking cane to the clamp by simply pushing the cane into place. The clamp is amenable to one-handed operation for release of the cane from the clamp when desired.

As depicted in the drawings, a conventional rollator 2 or walker 2' includes vertically and horizontally disposed tubing assembled into a pair of side frames, each side frame including a rear leg 4, a front leg 5, and a hand rail or grip 8. The two side frames are connected by cross-members 6 to create an open cage-like structure. Variations of such conventional walkers and rollators are also well-known, e.g., rollators that are formed from two triangular side frames that may be configured to incorporate a chair like structure and hand brakes. Conventional walkers and rollators may also incorporate collapsible aspects to allow folding for transport or storage. Telescoping legs may also be utilized in their construction. Indeed, it is contemplated that any style of walker or rollator may be utilized in accordance with the current disclosure. Furthermore, it is contemplated that a cane clamp herein may used in connection with any available tubing or legs associated with, e.g., tables, chairs, lamps, bed rails and the like, where convenient storage of a walking cane is desired.

Figure 18:
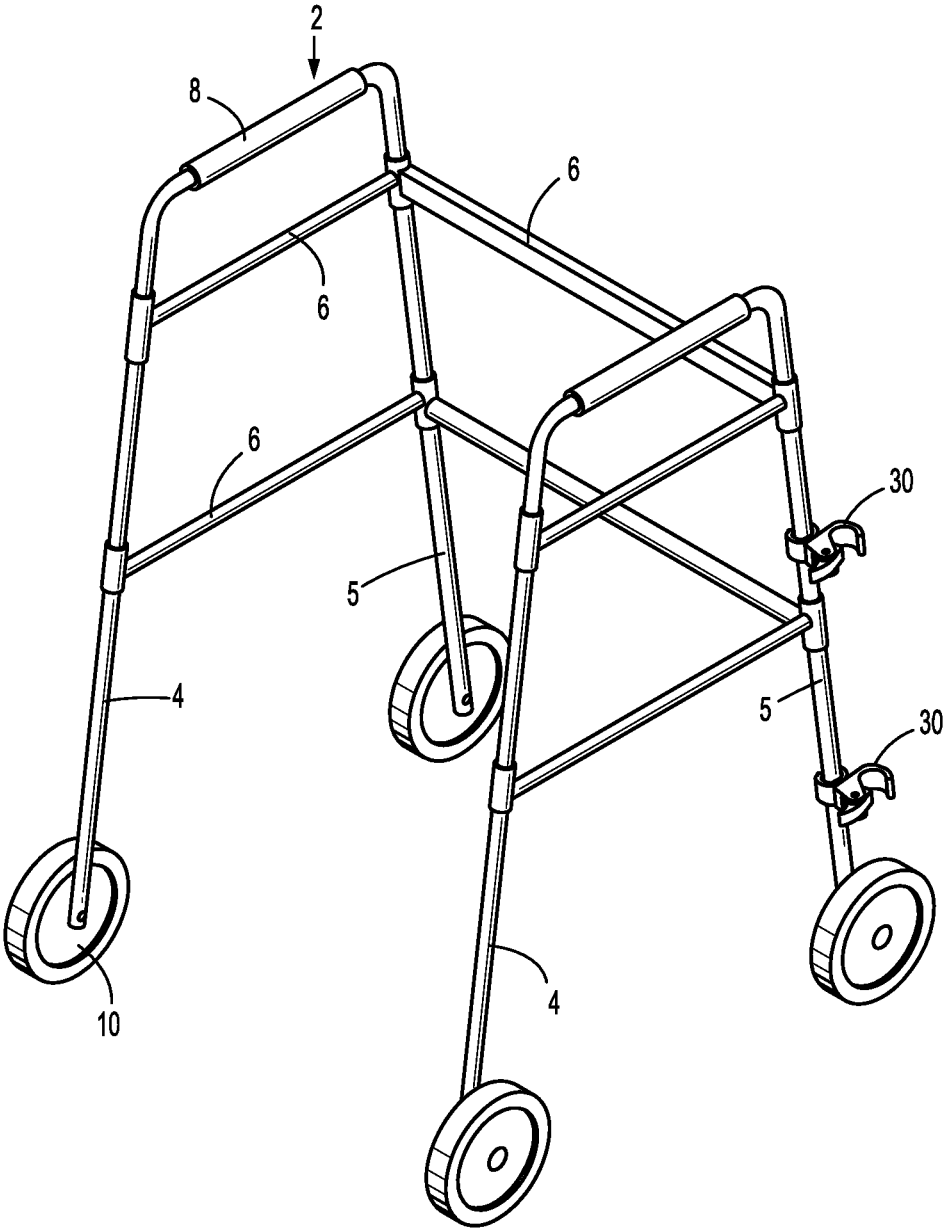
FIG. 18 is a perspective view of the rollator having two walking cane clamps attached to a single leg.

As can be seen, e.g., from FIGS. 1-5, and 14-16, a tripod walking cane 12 or a single tip walking cane 12' is attached to a rollator 2 or walker 2' via the cane clamp 30 which, in embodiments, is mounted on a front leg 5 of the rollator 2 or walker 2' by a clip 32 or 32'. It should be understood that the cane clamp 30 may also be mounted on either of the front legs 5 or either of the rear legs 4. In embodiments, more than one clamp 30 may be mounted on the rollator 2 or walker 2', e.g., on the same or different legs, which would allow two or more canes to be attached to a rollator or walker. In embodiments, two clamps 30 can be mounted a suitable distance apart on the same leg, thus providing two points of attachment to the cane 12, 12'. See, e.g., FIG. 18. It should also be understood that although a clip 32 is shown, e.g., generally in the drawings, those skilled in the art are familiar with other attachment modalities such as brackets which may be utilized herein.

Figure 8:
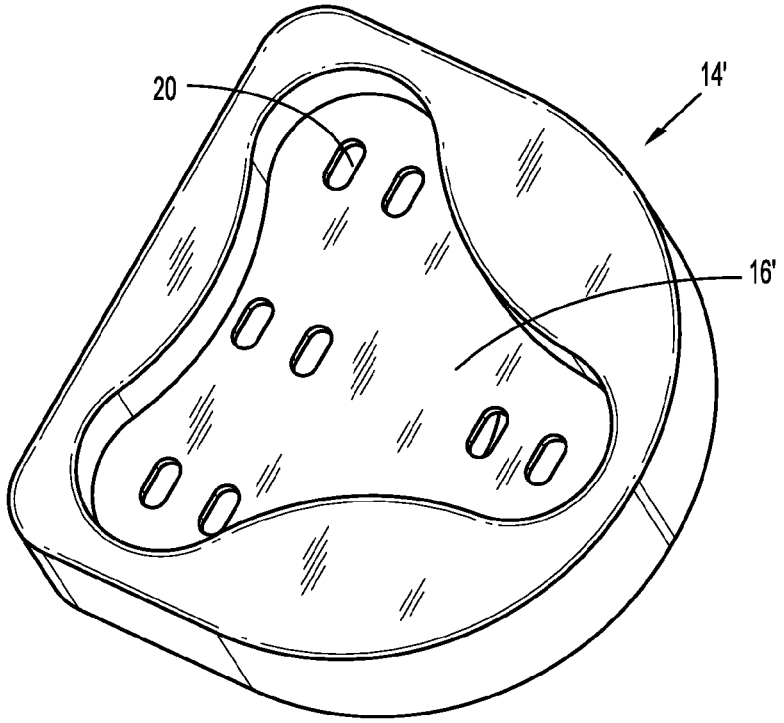
FIG. 8 is a perspective view of the base for receiving a walking cane and a receptacle for a tripod cane base and drainage ports.
Figure 9:
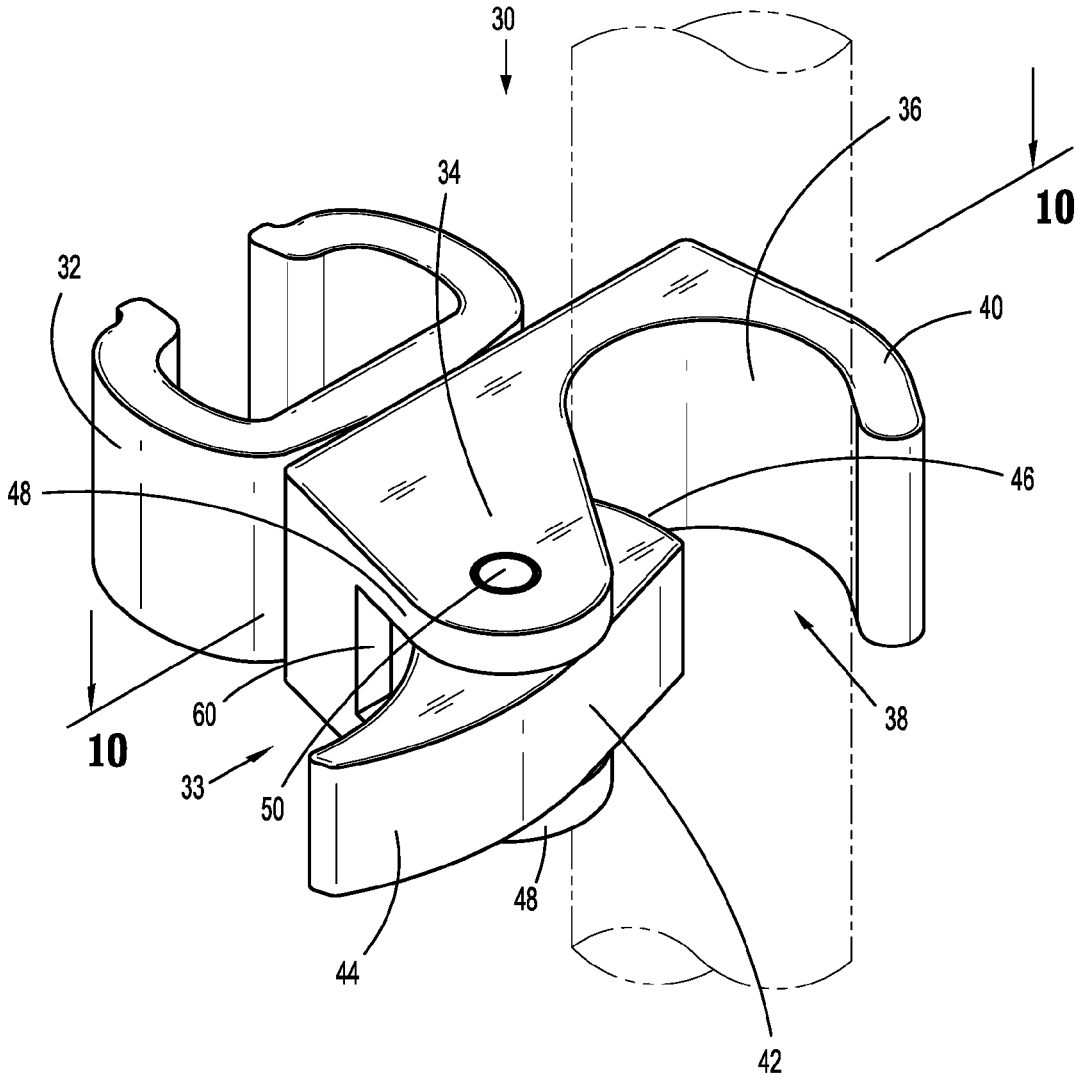
FIG. 9 is an enlarged perspective view of the walking cane clamp.

In embodiments, the clamp 30 is mounted above a base 14 for receiving a tripod cane or a single tip cane. See, e.g., FIGS. 1, 4 and 14. The clamp 30 and the base 14 cooperate to maintain the cane 12 or 12' in alignment with legs 4 or 5. See, e.g., FIGS. 4-6 and 14-15. The base 14 may be mounted to legs 4, 5 by a conventional clip, bracket or the like (not shown). As can be seen from FIGS. 1, 2, 7, 14 and 15, the base 14, which can receive a tripod base 13 of a tripod cane 12 or a single tip base 13' of a single tip cane 12', is generally D shaped, having a centrally disposed depression which includes a tripod base receptacle 16 and a single cane tip receptacle 18 which are respectively dimensioned and configured to receive a tripod cane base 13 and a single cane tip base 13'. Optional drainage ports 20, may be incorporated to allow air circulation and/or drainage of dirt or liquids such as water from the depression. In this manner, cleaning of the depression may be facilitated. In embodiments, a base 14' is directed to a tripod base receptacle 16' without a single cane tip receptacle. See, e.g., FIG. 8. In embodiments, a base 14" is directed to a single cane tip receptacle 18' without a tripod base receptacle. See, e.g., FIG. 16. It should be understood that in embodiments where two or more clamps 30 are mounted on a single leg, there may be no need to provide the base 14, 14' or 14".

The base 14, 14', 14" may be made of any well-known suitable material such as polymers, metals or composites. Suitable polymers include, e.g., polycarbonates, polystyrenes, polyamides, etc. Suitable metals include, e.g., aluminum, titanium, stainless steel, etc. Composites may include, e.g., fiberglass, carbon fibers, etc. Those skilled in the art are familiar with conventional manufacturing techniques suitable for use in making the base 14, 14', 14" such as thermoplastic molding, extrusion and the like.

As can be seen, e.g., from FIGS. 9-13, the clamp 30 includes the clip 32 attached to a cane fastener 33. In embodiments, the clip 32 is fixedly attached to the cane fastener 33. In embodiments, the clip 32 is rotatably attached to the cane fastener 33 which allows the clip to rotate relative to the cane fastener 33 or the cane fastener 33 to rotate relative to the clip 32. The clip 32 is dimensioned and configured to engage and mount to the legs 4, 5 and/or cross members 6 of a rollator 2 or walker 2'. In embodiments, the clip 32 defines an elongate C-shape which is dimensioned and configured to engage and mount to legs 4, 5 and/or cross-bars having a rectangular cross section. In embodiments, a clip 32' has a reduced interior dimension compared to the elongated C-shape which can engage and mount to legs and/or cross-bars having a smaller and or circular cross section.

The cane fastener 33 includes a body portion 34 having an arcuate receptacle 36 and an opening 38. The arcuate receptacle 36 and opening 38 are dimensioned and configured to receive a portion of the shaft of the cane 12, 12'. The arcuate receptacle 36 terminates on one side with a first hook portion 40 and on an opposite side with a second hook portion 41. The cane fastener 33 includes a biasing member 42 pivotally attached to the body portion 34, the biasing member 42 being disposed opposite the first hook portion 40. The biasing member 42 includes an outer surface 43, a tail portion 44 at one end and a cam surface 46 at the other end. The tail portion 44 provides a surface that is easily grasped, pushed or pulled by the user of the clamp 30 to manipulate the biasing member 42. The biasing member 42 is pivotally attached to retaining walls 48 of the body 34 via a pivot rod 50 mounted between the retaining walls 48. The biasing member 42 defines an open position and a closed position of the arcuate receptacle 36. A torsion spring 52 is mounted on the pivot rod 50 causing the biasing member 42 to be pivotally biased toward the closed position in which a portion of the biasing member 42 covers a portion of the opening 38 as shown, e.g., in FIG. 10. The torsion spring 52 has two spring ends 54 that are respectively engaged and retained by a first torsion spring end stop 56 disposed on the body 34 and a second torsion spring end stop 58 disposed on the biasing member 42 for maintaining tension (spring loaded) on the biasing member 42 thus creating the closed position bias. The body 34 includes a biasing member stop 60 which engages a stop engaging surface 62 of the biasing member 42 to limit the range of motion of the biasing member 42, thus preventing the biasing member 42 from extending fully past the opening 38 of the body 34.

The clamp 30 may be made of any well-known suitable material such as polymers, metals or composites. Suitable polymers include, e.g., polycarbonates, polystyrenes, polyamides, etc. Suitable metals include, e.g., aluminum, titanium, stainless steel, etc. Composites may include, e.g., fiberglass, carbon fibers, etc. Those skilled in the art are familiar with conventional manufacturing techniques suitable for use in making the clamp 30 such as thermoplastic molding, extrusion and the like.

Figure 10:
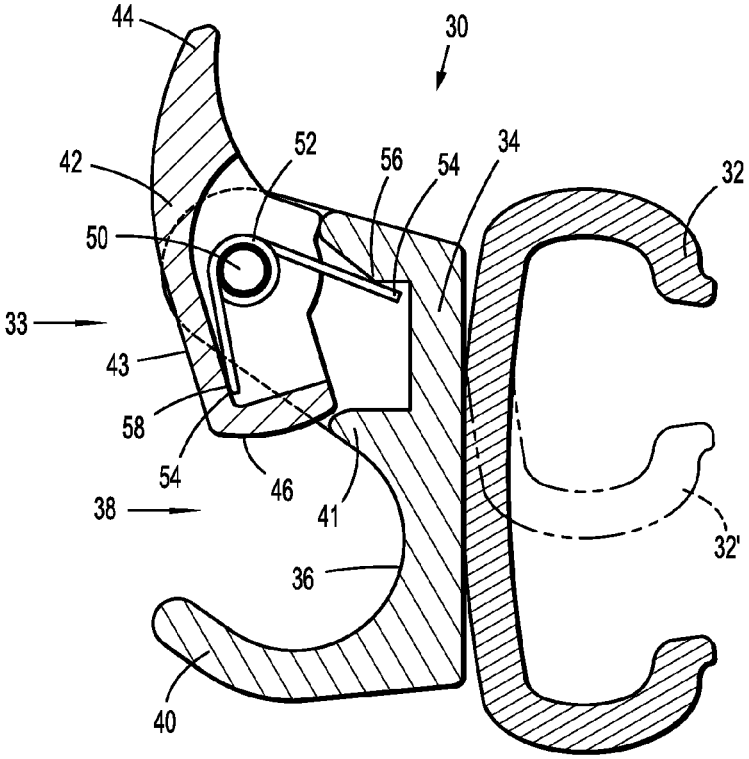
FIG. 10 is a cross-sectional view of the walking cane clamp shown along line 10-10 of FIG. 9.
Figure 11:
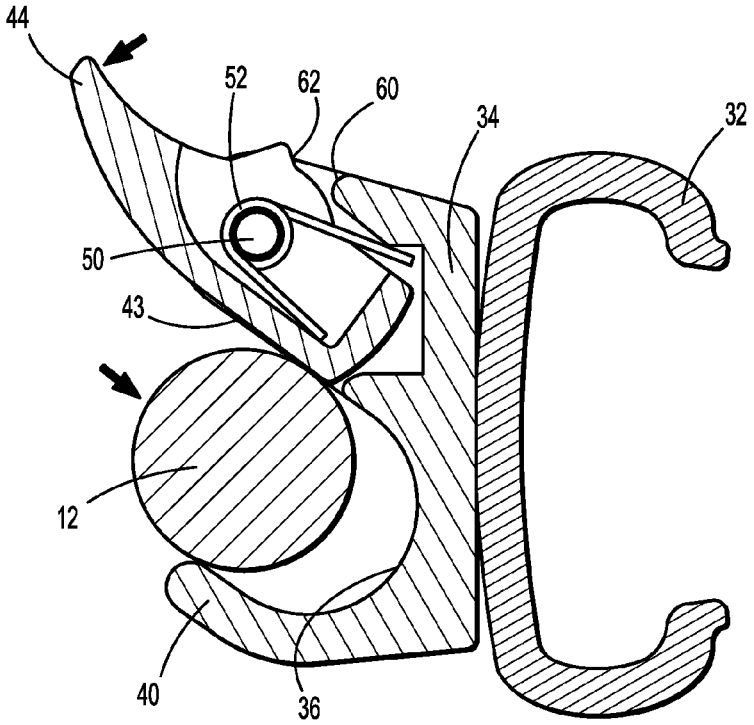
FIG. 11 is a cross-sectional view of the walking cane clamp shown along line 10-10 of FIG. 9 further depicting a walking cane positioned for insertion at the opening of a receptacle for a portion of the shaft of the walking cane.
Figure 12:
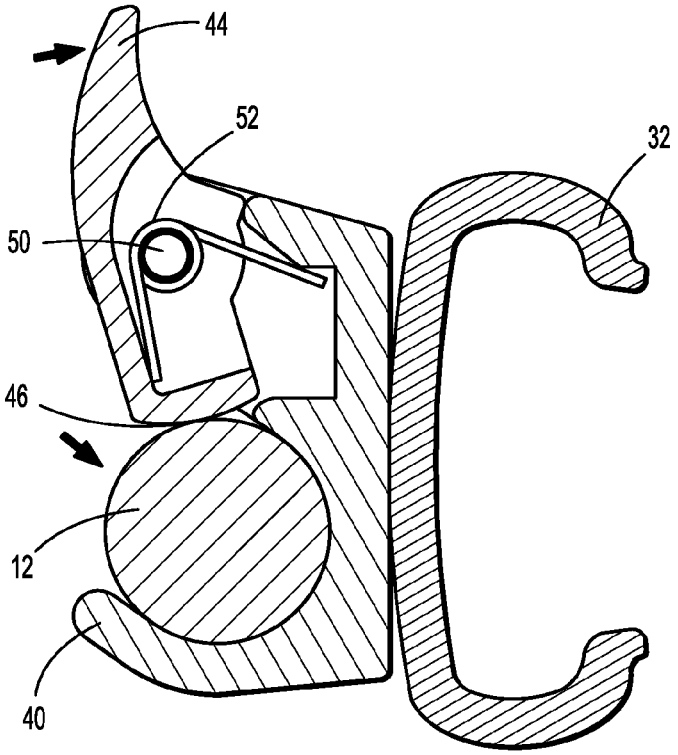
FIG. 12 is a cross-sectional view of the walking cane clamp shown along line 10-10 of FIG. 9 further depicting a walking cane secured within the receptacle for a portion of the shaft of the walking cane.
Figure 13:
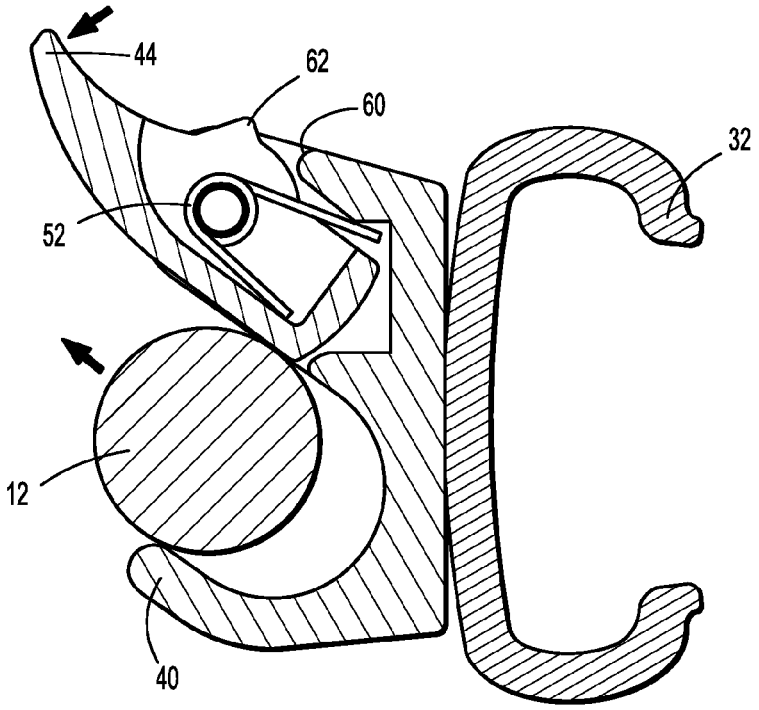
FIG. 13 is a cross-sectional view of the walking cane clamp shown along line 10-10 of FIG. 9 further depicting a walking cane positioned for removal at the opening of a receptacle for a portion of the shaft of the walking cane.
Figure 15:
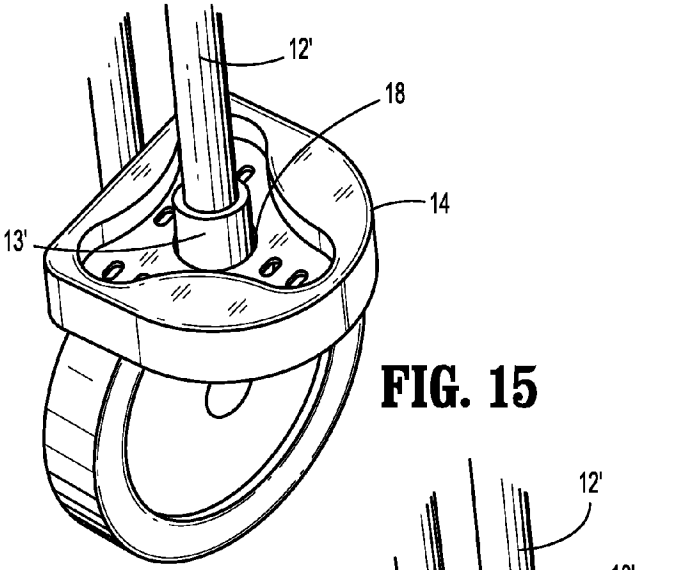
FIG. 15 is an enlargement of the highlighted portion 15 of FIG. 14 depicting the base for receiving a walking cane and bottom portion of a single tip walking cane within the base.
Figure 16:
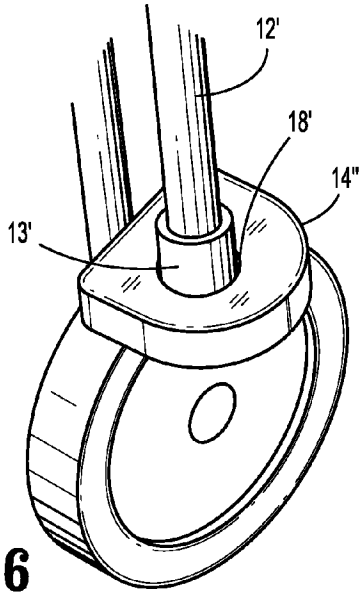
FIG. 16 is a perspective view of a base for receiving a single tip walking cane and a portion of a single tip cane mounted in the base.
Figure 14:
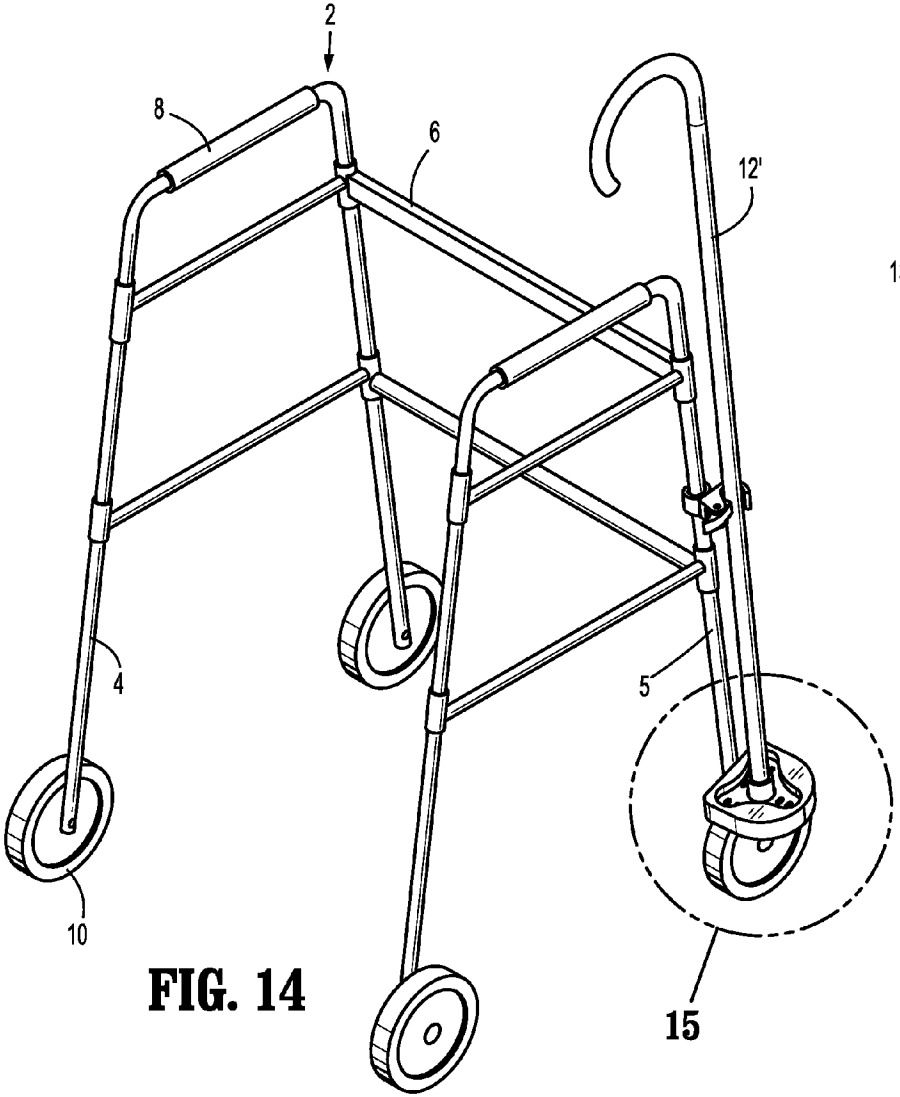
FIG. 14 is a perspective view of the rollator, walking cane clamp, base for receiving a walking cane, and a single tip walking cane, wherein the single tip walking cane is mounted to the rollator via the walking cane clamp and base for receiving a walking cane.

In operation, the clamp 30 is mounted to a rollator 2 or walker 2' and, as shown in FIGS. 10-13, the cane fastener 33 is in an unoccupied initial position wherein the biasing member 42 is in the closed position which blocks a portion of the opening 38 (see, e.g., FIG. 10). As shown in FIG. 11, the cane 12 or 12' is placed or pushed into the opening 38, between the first hook portion 40 and the biasing member 42. As the cane 12 or 12' is pushed into the arcuate receptacle 36 and against the biasing member 42, the outer surface 43 of the biasing member 42 moves pivotally into alignment with the second hook portion 41 of the arcuate receptacle 36, thus assuming the open position and providing a clear path guiding the cane shaft into the arcuate receptacle 36. When the cane shaft is fully inserted into arcuate receptacle 36, the cane shaft no longer keeps the biasing member 42 in the open position, the cam surface 46 of the spring loaded biasing member 42 slides over the cane shaft, and the biasing member 42 springs into the closed position, thereby securing the cane within the arcuate receptacle 36. See, e.g., FIG. 12. As shown, e.g., in FIG. 13, removal of the cane 12, 12' is accomplished by pushing the tail portion 44 of the biasing member 42 to cause the biasing member to pivot into the open position where the outer surface 43 of the biasing member 42 is in alignment with the second hook portion 41 of the arcuate receptacle 36, providing a clear path for guiding the cane 12, 12' out of the arcuate receptacle 36 and out of the clamp 30.

When utilizing the base 14, 14' or 14", the clamp 30 is positioned above the base 14, 14' or 14" on legs 4 or 5 of the rollator 2 or walker 2' by a sufficient distance to allow operation of the clamp 30 and mounting of the cane 12 or 12' to the legs 4, 5. A sufficient distance may be determined on a case by case basis based on the needs or ability of the user. For example, separation by 2 or more inches, 4 or more inches, 6 or more inches, 8 or more inches, 10 or more inches, 12 or more inches, 14 or more inches, 16 or more inches, 18 or more inches, 20 or more inches, 22 or more inches, 24 or more inches, 26 or more inches, 28 or more inches, 30 or more inches, 32 or more inches, 34 or more inches, or 36 or more inches. After the clamp and base are in position, the tripod base 13 of a tripod cane 12 can be placed into the base 14 or 14' (see, e.g., FIGS. 1-5), or the single tip base 13' of a single tip cane 12' can be placed into the base 14 or 14" (see, e.g., FIGS. 14-16) and the shaft of the cane 12 or 12' simply pushed into the arcuate receptacle of the cane fastener 33 as described above to secure the cane to the rollator 2 or walker 2' in parallel alignment with the legs 4 or 5. See, e.g., FIGS. 1-6 and 14-16. Alternatively, after the clamp and base are in position, the shaft of the cane 12 or 12' can first be pushed and secured into the arcuate receptacle of the cane fastener 33 as described above, and the cane 12 or 12' is slid downwardly until the tripod base 13 of a tripod cane 12 is placed into the base 14 or 14' or the single tip base 13' of a single tip cane 12' is placed into the base 14 or 14", to secure the cane to the rollator 2 or walker 2' in parallel alignment with the legs 4 or 5. The cane fastener 33 may be rotated relative to the clip 32 when the clip 32 is rotatably attached to the cane fastener 33 which can facilitate placement and mounting of the cane. Rotational ability may also allow the user to rotate the cane from vertical to horizontal and even further, e.g., up to 180°, and allow the user to inspect the bottom of the cane or adjust cane height while the cane is still mounted to the clamp 30.

Figure 17:
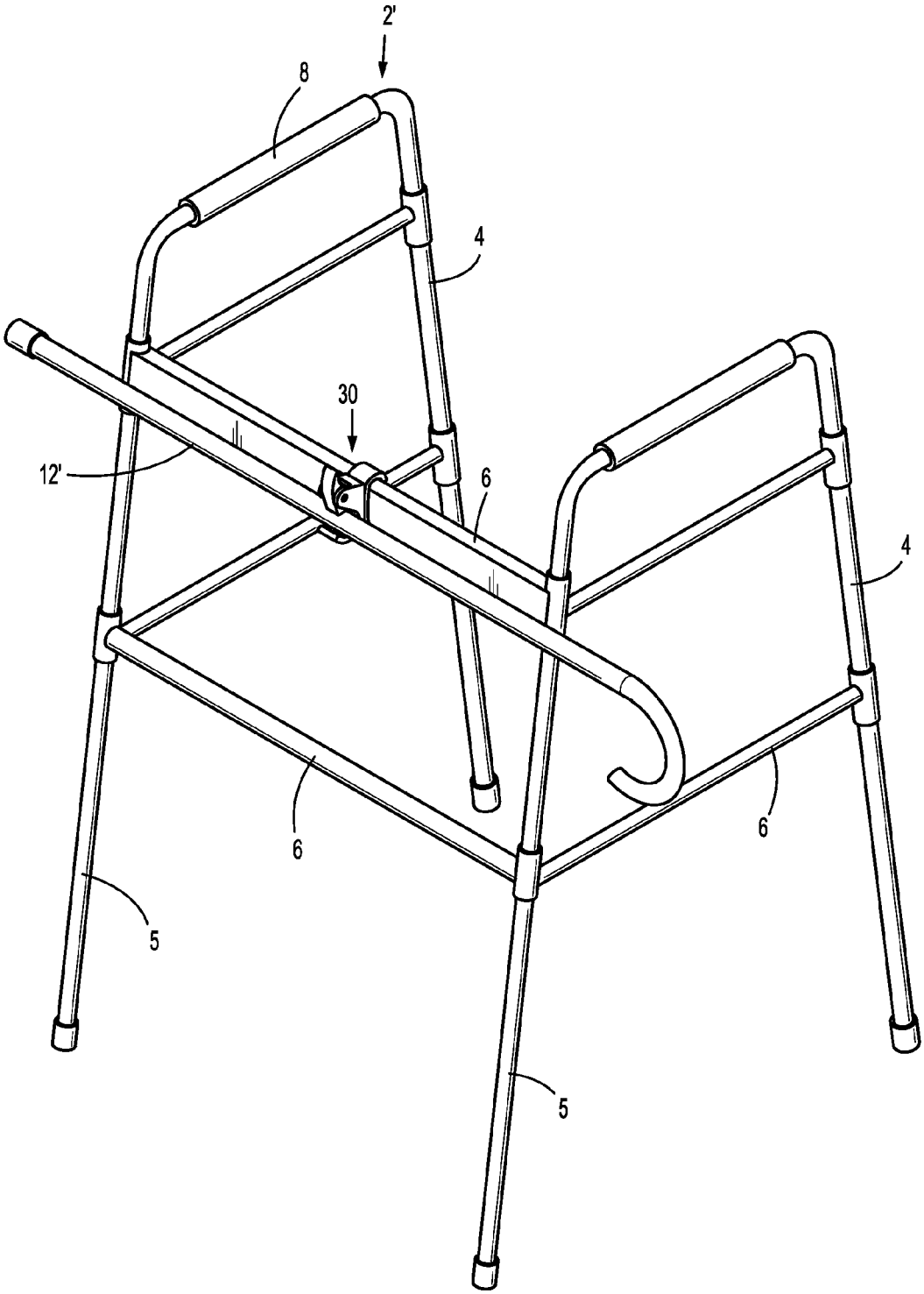
FIG. 17 is a perspective view of a walker, the walking cane clamp and a single tip walking cane, wherein the walking cane clamp is mounted to a cross-member of the walker and a single tip walking cane is mounted to the walker via the walking cane clamp.

In embodiments, the cane 12 or 12' is mounted to a cross-member 6 of rollator 2 or walker 2'. See, e.g., FIG. 17. Instead of vertical orientation as when mounted on the legs 4 or 5, the cane 12 or 12' is mounted horizontally. Users who have difficulty bending down may find it easier to manipulate a horizontally mounted cane. It is contemplated that two or more clamps 30 may be placed at a distance apart on the cross-member 6 to provide two points of attachment on the cross-member and thereby stabilize the cane 12 or 12'. It is also contemplated that the base 14, 14' or 14" may also be mounted on the cross-bar to stabilize the cane. The cane fastener 33 may be rotated relative to the clip 32 when the clip is rotatably attached to the cane fastener. In this manner, the cane may initially be placed in a horizontal orientation and then rotated into a vertical orientation. Conversely, the cane may initially be placed in a vertical orientation and then rotated into a horizontal orientation, parallel with the cross-member.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. A walking cane clamp comprising:

a clip dimensioned and configured to releasably secure the walking cane clamp to a support member, the clip being attached to a cane fastener, the cane fastener including a body portion and a biasing member pivotally attached to the body portion, the body portion including a biasing member stop, the biasing member having a stop engaging surface, an outer surface and a transversely disposed cam surface, the body portion defining an opening and a receptacle dimensioned and configured to receive a portion of a cane shaft, the biasing member defining an open position and a closed position of the receptacle, such that when the biasing member defines the closed position of the receptacle, the biasing member stop of the body portion and the stop engaging surface of the biasing member cooperate to prevent the biasing member from covering more than half of the opening, and when the biasing member defines the open position, the outer surface of the biasing member defines a surface for slidably guiding the portion of the cane shaft into the receptacle, the biasing member being pivotally biased toward the closed position in which the cam surface of the biasing member covers a portion of the opening sufficient to secure the cane shaft within the receptacle.

2. The walking cane clamp according to claim 1, wherein the biasing member is spring loaded.

3. The walking cane clamp according to claim 2, wherein the spring is a torsion spring.

4. The walking cane clamp according to claim 1, wherein the biasing member stop prevents the biasing member from extending fully past the opening.

5. The walking cane clamp according to claim 1, wherein the receptacle is arcuate.

6. The walking cane clamp according to claim 1, wherein the biasing member has a first end and a second end, the first end comprising the cam surface for abutting the portion of the cane shaft when in the closed position and the second end defining a tail portion which acts as a lever for pushing the biasing member into the open position.

7. The walking cane clamp according to claim 1, wherein the clip is directly attached to the cane fastener and rotatable relative to the cane fastener.

8. A system for securing a walking cane to a walker or a rollator comprising:

a walking cane clamp according to claim 1 and a base for receiving the walking cane, the base for receiving the walking cane including a base clip for securing the base for receiving the walking cane to the support member, the base for receiving the walking cane including a receptacle for receiving an end of the walking cane, wherein the walking cane clamp and the base for receiving the walking cane cooperate to secure the walking cane to the support member.

9. The system for securing a walking cane to a walker or a rollator according to claim 8, wherein the base for receiving the walking cane is dimensioned and configured to receive a tripod base of a tripod cane.

10. The system for securing a walking cane to a walker or a rollator according to claim 8, wherein the base for receiving the walking cane is dimensioned and configured to receive a cane tip.

11. The system for securing a walking cane to a walker or a rollator according to claim 8, wherein the base for receiving the walking cane is dimensioned and configured to receive both a cane tip and a tripod base of a tripod cane.

12. The system for securing a walking cane to a walker or a rollator according to claim 8, wherein the base for receiving the walking cane includes at least one drainage port.

13. A walker or rollator comprising:

a pair of side frames, each side frame including a front leg, a rear leg, at least one hand rail, and at least one cross-member joining each side frame; and a walking cane clamp including a clip dimensioned and configured to secure the walking cane clamp to the walker or rollator, the clip being attached to a cane fastener, the cane fastener including a body portion and a biasing member pivotally attached to the body portion, the body portion including a biasing member stop, the biasing member having a stop engaging surface, an outer surface and a transversely disposed cam surface, the body portion defining an opening and a receptacle dimensioned and configured to receive a portion of a cane shaft, the biasing member defining an open position and a closed position of the receptacle, such that when the biasing member defines the closed position of the receptacle, the biasing member stop of the body portion and the stop engaging surface of the biasing member cooperate to prevent the biasing member from covering more than half of the opening, and when the biasing member defines the open position, the outer surface of the biasing member defines a surface for slidably guiding the portion of the cane shaft into the receptacle, the biasing member being pivotally biased toward the closed position in which the cam surface of the biasing member covers a portion of the opening sufficient to secure the cane shaft within the receptacle.

14. The walker or rollator according to claim 13 further comprising a base for receiving the walking cane, the base for receiving the walking cane including a base clip for securing the walking cane base to the walker or rollator, the base for receiving the walking cane including a receptacle for receiving an end of the walking cane, wherein the walking cane clamp and the base for receiving the walking cane cooperate to secure the walking cane to the walker or rollator.

15. The walker or rollator according to claim 14, wherein the walking cane clamp and the base for receiving the walking cane are both secured to a single front leg or a single rear leg.

16. The walker or rollator according to claim 15, wherein the walking cane clamp and the base for receiving the walking cane cooperate to orient the walking cane parallel to the single front leg or the single rear leg.

17. The walker or rollator according to claim 14, wherein the walking cane clamp and the base for receiving the walking cane are both secured to the at least one cross-member.

18. The walker or rollator according to claim 17, wherein the walking cane clamp and the base for receiving the walking cane cooperate to orient the walking cane parallel to the at least one cross-member.

19. The walker or rollator according to claim 14, wherein the base for receiving the walking cane is dimensioned and configured to receive a cane tip.

20. The walker or rollator according to claim 14, wherein the base for receiving the walking cane is dimensioned and configured to receive a tripod base of a tripod cane.

21. The walker or rollator according to claim 14, wherein the base for receiving the walking cane is dimensioned and configured to receive both a cane tip and a tripod base of a tripod cane.

22. The walker or rollator according to claim 14, wherein the base for receiving the walking cane includes at least one drainage port.

23. The walker or rollator according to claim 13, wherein two walking cane clamps are secured to a single front leg or a single rear leg.

24. The walker or rollator according to claim 13, wherein the walking cane clamp is secured to the at least one cross-member.

25. The walker or rollator according to claim 13, wherein the biasing member is spring loaded.

26. The walker or rollator according to claim 25, wherein the spring is a torsion spring.

27. The walker or rollator according to claim 13, wherein the biasing member stop prevents the biasing member from extending fully past the opening.

28. The walker or rollator according to claim 13, wherein the receptacle is arcuate.

29. The walker or rollator according to claim 13, wherein the biasing member has a first end and a second end, the first end defining a cam surface for abutting the portion of the cane shaft when in the closed position and the second end defining a tail portion which acts as a lever for pushing the biasing member into the open position.

30. A walking cane clamp comprising:

a clip dimensioned and configured to releasably secure the walking cane clamp to a support member, the clip being attached to a cane fastener, the cane fastener including a body portion and a biasing member pivotally attached to the body portion, the body portion including a biasing member stop, the body portion defining an opening and a receptacle dimensioned and configured to receive a portion of a cane shaft, the biasing member including a stop engaging surface, the biasing member defining an open position and a partially closed position of the receptacle, the biasing member being pivotally biased toward the partially closed position in which a portion of the biasing member covers no more than half of the opening to secure the cane shaft within the receptacle, wherein the biasing member stop of the body portion and the stop engaging surface of the biasing member cooperate to prevent the biasing member from covering more than half of the opening.

* * * * *